US011659344B2

(12) United States Patent
Hashimoto et al.

(10) Patent No.: US 11,659,344 B2
(45) Date of Patent: May 23, 2023

(54) SOUND SIGNAL PROCESSING METHOD, SOUND SIGNAL PROCESSING DEVICE, AND STORAGE MEDIUM THAT STORES SOUND SIGNAL PROCESSING PROGRAM

(71) Applicant: YAMAHA CORPORATION, Hamamatsu (JP)

(72) Inventors: Dai Hashimoto, Hamamatsu (JP); Takayuki Watanabe, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/329,262

(22) Filed: May 25, 2021

(65) Prior Publication Data

US 2021/0385597 A1 Dec. 9, 2021

(30) Foreign Application Priority Data

Jun. 3, 2020 (JP) ..... JP2020-096756

(51) Int. Cl.
*H04R 29/00* (2006.01)
*H04R 1/22* (2006.01)

(52) U.S. Cl.
CPC ..... *H04R 29/004* (2013.01); *H04R 1/222* (2013.01)

(58) Field of Classification Search
CPC ..... H04R 29/004; H04R 1/222; H04R 27/00; H04S 7/305; H04S 7/30; H04S 7/301; H04S 7/302; H04S 7/303
See application file for complete search history.

(56) References Cited

U.S. PATENT DOCUMENTS

| | | | | |
|---|---|---|---|---|
| 5,642,425 | A | 6/1997 | Kawakami | |
| 2007/0025560 | A1 | 2/2007 | Asada | |
| 2009/0296962 | A1* | 12/2009 | Shirakihara | G10K 15/12 381/111 |
| 2010/0135510 | A1* | 6/2010 | Yoo | G10L 19/008 381/26 |
| 2012/0063608 | A1 | 3/2012 | Soulodre | |
| 2013/0010984 | A1* | 1/2013 | Hejnicki | H04R 27/00 381/107 |
| 2016/0125871 | A1* | 5/2016 | Shirakihara | G10K 15/08 381/63 |
| 2020/0388296 | A1* | 12/2020 | Von Tuerckheim | G10L 21/0208 |

FOREIGN PATENT DOCUMENTS

| | | | |
|---|---|---|---|
| EP | 3026666 | A1 | 6/2016 |
| JP | H06284493 | A | 10/1994 |
| JP | 2006245670 | A | 9/2006 |

OTHER PUBLICATIONS

Extended European search report issued in European Appln. No. 21177096.1 dated Oct. 26, 2021.

* cited by examiner

*Primary Examiner* — Jason R Kurr
(74) *Attorney, Agent, or Firm* — Rossi, Kimms & McDowell LLP

(57) ABSTRACT

A sound signal processing method includes receiving a sound signal, generating an early reflection sound control signal that reproduces an early reflection sound and a reverberant sound control signal that reproduces a reverberant sound from the sound signal, controlling a volume of the sound signal and distributing the sound signal to generate a direct sound control signal, and mixing the direct sound control signal, the early reflection sound control signal that reproduces a direct sound, and the reverberant sound control signal to generate an output signal.

15 Claims, 7 Drawing Sheets

SOUND SIGNAL PROCESSING METHOD, SOUND SIGNAL PROCESSING DEVICE, AND STORAGE MEDIUM THAT STORES SOUND SIGNAL PROCESSING PROGRAM

CROSS REFERENCE TO RELATED APPLICATIONS

This Nonprovisional application claims priority under 35 U.S.C. § 119(a) on Patent Application No. 2020-096756 filed in Japan on Jun. 3, 2020, the entire contents of which are hereby incorporated by reference.

BACKGROUND

Technical Field

One embodiment of the present disclosure relates to a sound signal processing method for processing an obtained sound signal.

Background Information

In facilities such as a concert hall, various genres of music are played and speeches such as a lecture are given. Such facilities are required to have various acoustic characteristics (for example, reverberant characteristics). For example, a performance requires a relatively long reverberant, and a speech requires a relatively short reverberant.

However, in order to physically change the reverberant characteristics in a hall, it is necessary to change the size of an acoustic space by, for example, moving the ceiling, which requires a very large-scale facility.

In view of the above, for example, a sound field control device as shown in JP H06-284493 A performs processing that supports a sound field by generating a reverberant sound by processing the sound obtained by a microphone with a finite impulse response (FIR) filter, and outputting the reverberant sound from a speaker installed in a hall.

SUMMARY

However, the sense of localization is blurred only by adding a reverberant sound. Recently, it has been desired to realize clearer sound image localization and richer space expansion.

In view of the above, an object of one embodiment of the present disclosure is to provide a sound signal processing method for controlling a richer acoustic space.

The sound signal processing method includes receiving a sound signal, generating an early reflection sound control signal that reproduces an early reflection sound and a reverberant sound control signal that reproduces a reverberant sound from the sound signal, controlling volume of the sound signal and distributing the sound signal to generate a direct sound control signal that reproduces a direct sound, and mixing the direct sound control signal, the early reflection sound control signal, and the reverberant sound control signal to generate an output signal.

The sound signal processing method can realize clearer sound image localization and richer space expansion.

DETAILED DESCRIPTION

Figure 1:
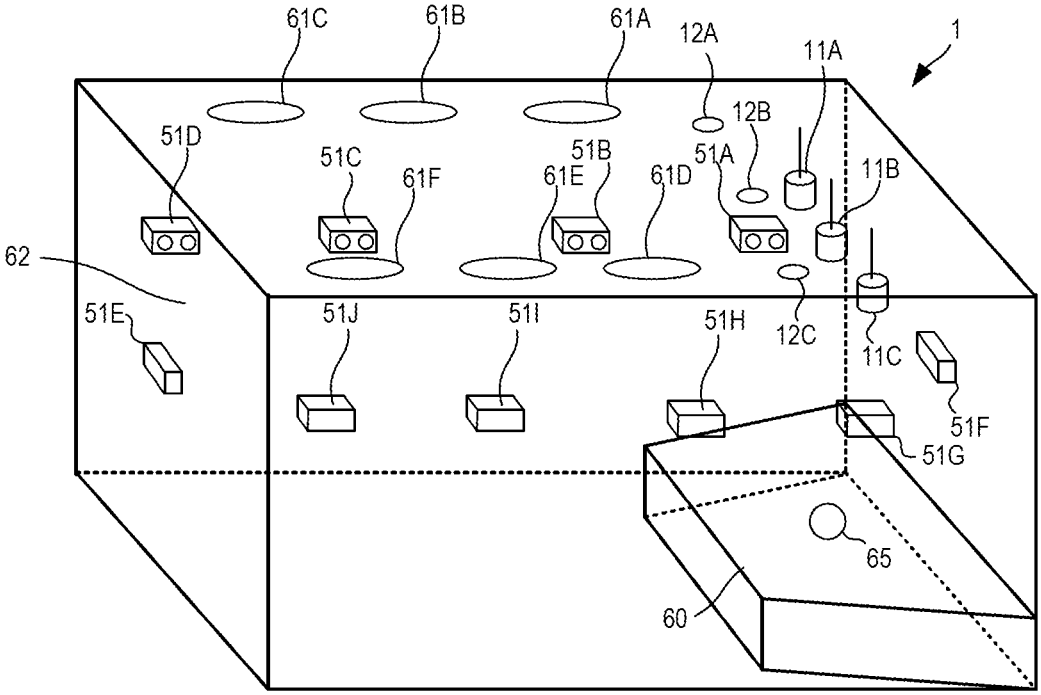
FIG. 1 is a transparent perspective view schematically illustrating a space of a first embodiment.
Figure 2:
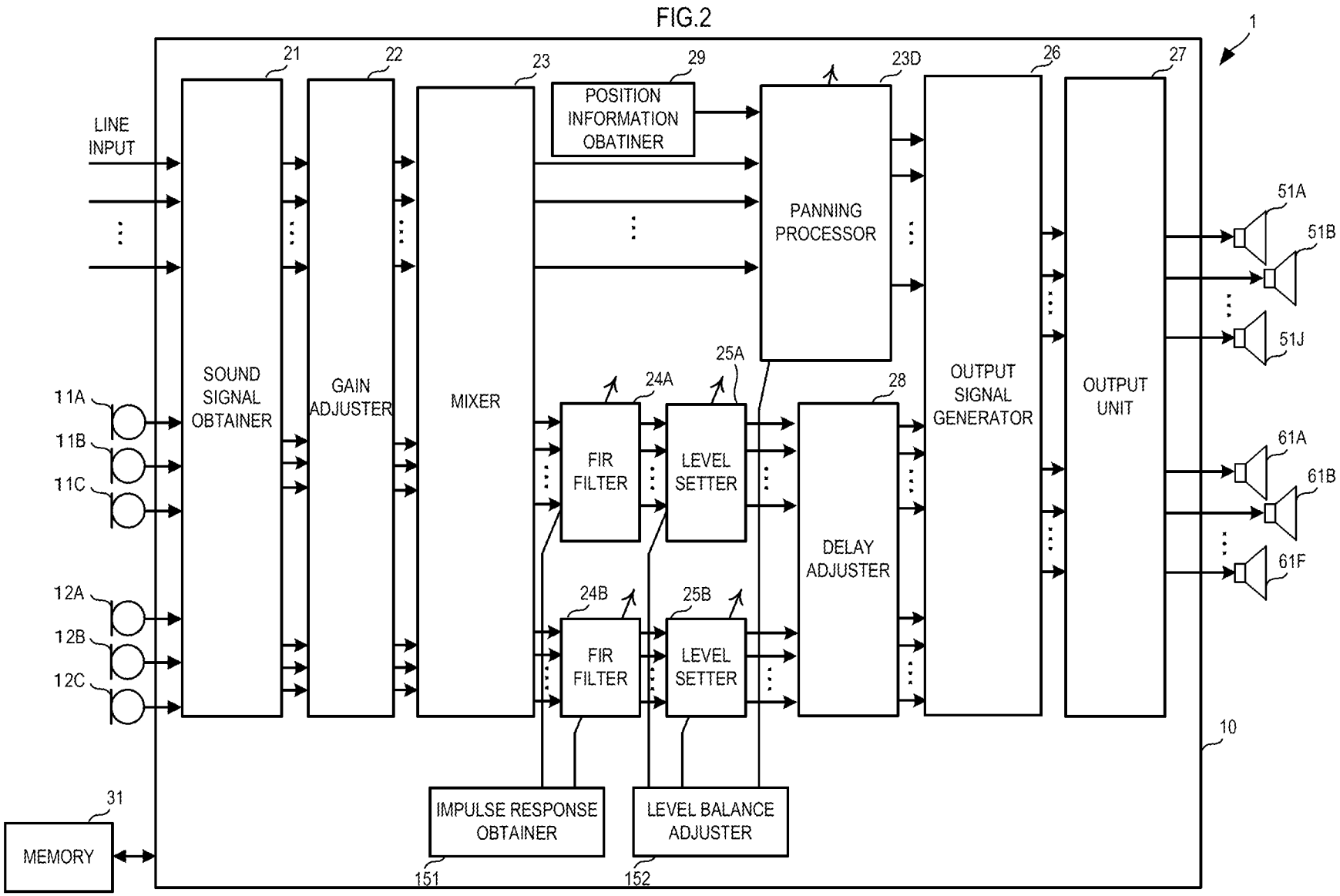
FIG. 2 is a block diagram illustrating a configuration of a sound field support system of the first embodiment.

FIG. 1 is a transparent perspective view schematically illustrating a room 62 constituting a space. FIG. 2 is a block diagram illustrating a configuration of a sound field support system 1.

The room 62 constitutes a space having a substantially rectangular parallelepiped shape. A sound source 65 exists on a stage 60 at the front of the room 62. The back of the room 62 corresponds to audience seats where listeners sit. The sound source 65 is, for example, a voice, a singing sound, an acoustic musical instrument, an electric musical instrument, an electronic musical instrument, or the like.

The shape of the room 62, the arrangement of sound sources, and the like are not limited to the example shown in FIG. 1. A sound signal processing method and a sound signal processing device of the present disclosure can provide a desired sound field in a space of any shape, and can realize a richer sound image and richer space expansion than before.

The sound field support system 1 includes, in the room 62, a directional microphone 11A, a directional microphone 11B, a directional microphone 11C, an omnidirectional microphone 12A, an omnidirectional microphone 12B, an omnidirectional microphone 12C, speakers 51A to 51J, and speakers 61A to 61F.

The speakers 51A to 51J are set on a wall surface. The speakers 51A to 51J are speakers with relatively high directivity, and mainly output sound toward audience seats. The speakers 51A to 51J output an early reflection sound control signal that reproduces an early reflection sound. Further, the speakers 51A to 51J output a direct sound control signal that reproduces a direct sound of the sound source.

The speakers 61A to 61F are installed on the ceiling. The speakers 61A to 61F are speakers with relatively low directivity, and output sound to the entire room 62. The speakers 61A to 61F output a reverberant sound control signal that reproduces a reverberant sound. Further, the speakers 61A to 61F output a direct sound control signal that reproduces a direct sound of the sound source. The number of speakers is not limited to the number shown in FIG. 1.

The directional microphone 11A, the directional microphone 11B, and the directional microphone 11C mainly collect the sound of the sound source 65 on the stage. However, as shown in FIG. 2, the sound of the sound source 65 may be received by line input. In the line input, the sound output from a sound source of an instrument or the like is not collected with a microphone and receive, but a sound signal is received from an audio cable or the like connected to the sound source. Alternatively, as the sound of the sound source 65, the voice or singing sound of a performer such as a speaker or a singer may be received from a hand microphone, a stand microphone, a pin microphone, or the like. The sound of the sound source is preferably collected at a high SN ratio.

The omnidirectional microphone 12A, the omnidirectional microphone 12B, and the omnidirectional microphone 12C are installed on the ceiling. The omnidirectional microphone 12A, the omnidirectional microphone 12B, and the omnidirectional microphone 12C collect the entire sound in the room 62, including the direct sound of the sound source 65 and the reflection sound in the room 62. The number of the directional microphones and the omnidirectional microphones shown in FIG. 1 is three each. However, the number of microphones is not limited to that in the example shown in FIG. 1. Further, the installation positions of the microphone and the speaker are not limited to those in the example shown in FIG. 1.

In FIG. 2, the sound field support system 1 includes a sound signal processor 10 and a memory 31 in addition to the configuration shown in FIG. 1. The sound signal processor 10 is mainly composed of a CPU and a digital signal processor (DSP). The sound signal processor 10 functionally includes a sound signal obtainer 21, a gain adjuster 22, a mixer 23, a panning processor 23D, a finite impulse response (FIR) filter 24A, an FIR filter 24B, a level setter 25A, a level setter 25B, an output signal generator 26, an output unit 27, a delay adjuster 28, a position information obtainer 29, an impulse response obtainer 151, and a level balance adjuster 152. The sound signal processor 10 is an example of the sound signal processing device of the present disclosure.

The CPU constituting the sound signal processor 10 reads an operation program stored in the memory 31 and controls each configuration. The CPU functionally constitutes the position information obtainer 29, the impulse response obtainer 151, and the level balance adjuster 152 by the operation program. The operation program does not need to be stored in the memory 31. The CPU may download the operation program from, for example, a server (not shown) each time.

Figure 3:
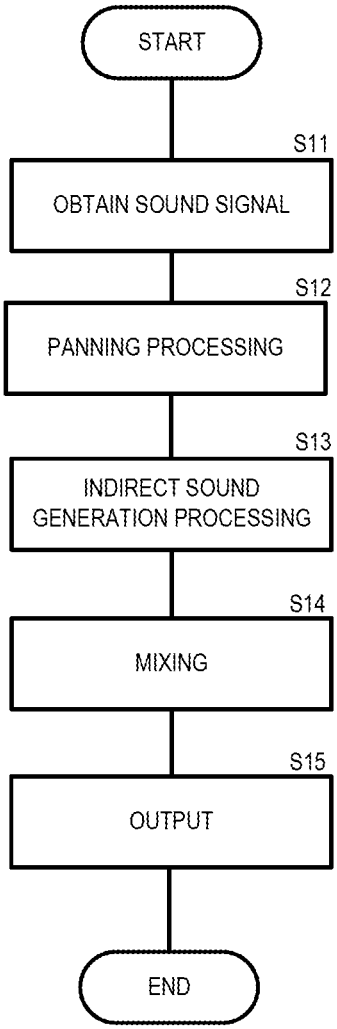
FIG. 3 is a flowchart showing operation of a sound signal processing device.

FIG. 3 is a flowchart showing the operation of the sound signal processor 10. First, the sound signal obtainer 21 obtains a sound signal (S11). The sound signal obtainer 21 obtains a sound signal from the directional microphone 11A, the directional microphone 11B, the directional microphone 11C, the omnidirectional microphone 12A, the omnidirectional microphone 12B, and the omnidirectional microphone 12C. Alternatively, the sound signal obtainer 21 may receive a sound signal from an electric musical instrument, an electronic musical instrument, or the like by line input. Further, the sound signal obtainer 21 may receive a sound signal from a microphone installed directly on a musical instrument or the performer such as a pin microphone. When obtaining an analog signal, the sound signal obtainer 21 converts the analog signal into a digital signal and outputs the signal.

The gain adjuster 22 adjusts a gain of the sound signal obtained by the sound signal obtainer 21. The gain adjuster 22 sets, for example, a gain of the directional microphone at a position close to the sound source 65 to be high. The gain adjuster 22 is not an essential configuration in the present disclosure.

The mixer 23 mixes the sound signal whose gain is adjusted by the gain adjuster 22. Further, the mixer 23 distributes the mixed sound signal to a plurality of signal processing systems.

The mixer 23 outputs the distributed sound signal to the panning processor 23D, the FIR filter 24A, and the FIR filter 24B.

For example, the mixer 23 distributes the sound signals obtained from the directional microphone 11A, the directional microphone 11B, and the directional microphone 11C to ten signal processing systems according to the speakers 51A to 51J. Alternatively, the mixer 23 may distribute line-inputted sound signals to ten signal processing systems according to the speakers 51A to 51J.

Further, the mixer 23 distributes the sound signals obtained from the omnidirectional microphone 12A, the omnidirectional microphone 12B, and the omnidirectional microphone 12C to six signal processing systems according to the speakers 61A to 61F.

The mixer 23 outputs the sound signals mixed in the ten signal processing systems to the panning processor 23D and the FIR filter 24A. Further, the mixer 23 outputs the sound signals mixed in six signal processing systems to the FIR filter 24B.

Hereinafter, the six signal processing systems that output a sound signal to the FIR filter 24B will be referred to as a first system or a reverberant sound system, and the ten signal processing systems that output a sound signal to the FIR filter 24A will be referred to as a second system or an early reflection sound system. Further, ten signal processing systems that output a sound signal to the panning processor 23D will be referred to as a third system or a direct sound system. The FIR filter 24A corresponds to an early reflection sound control signal generator, and the FIR filter 24B corresponds to a reverberant sound control signal generator. The panning processor 23D corresponds to a direct sound control signal generator.

The mode of distribution is not limited to that in the above example. For example, sound signals obtained from the omnidirectional microphone 12A, the omnidirectional microphone 12B, and the omnidirectional microphone 12C may be distributed to the direct sound system or the early reflection sound system. Further, a line-inputted sound signal may be distributed to the reverberant sound system. Further, a line-inputted sound signal and sound signals obtained from the omnidirectional microphone 12A, the omnidirectional microphone 12B, and the omnidirectional microphone 12C may be mixed and distributed to the direct sound system or the early reflection sound system.

The mixer 23 may have a function of electronic microphone rotator (EMR). The EMR is a method of flattening the frequency characteristics of a feedback loop by changing a transfer function between a fixed microphone and a speaker over time. The EMR is a function that switches a connection relationship between a microphone and a signal processing system from moment to moment. The mixer 23 outputs a sound signal obtained from the directional microphone 11A, the directional microphone 11B, and the directional microphone 11C to the panning processor 23D and the FIR filter 24A by switching an output destination. Alternatively, the mixer 23 outputs the sound signal obtained from the omnidirectional microphone 12A, the omnidirectional microphone 12B, and the omnidirectional microphone 12C to the FIR filter 24B by switching an output destination. In this manner, the mixer 23 can flatten the frequency characteristics of an acoustic feedback system from a speaker to a microphone in the room 62. Further, the mixer 23 can ensure stability against howling.

Next, the panning processor 23D controls the volume of each sound signal of the direct sound system according to the position of the sound source 65 (S12). In this manner, the panning processor 23D generates a direct sound control signal.

Figure 4:
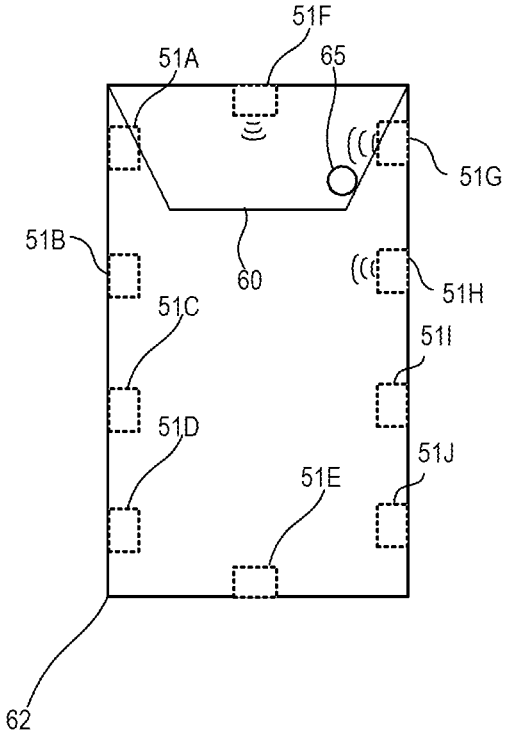
FIG. 4 is a plan view schematically illustrating a relationship between a room 62, speakers 51A to 51J, and a sound source 65.

FIG. 4 is a plan view schematically illustrating a relationship between the room 62, the speakers 51A to 51J, and the sound source 65, In the example of FIG. 4, the sound source 65 is located on the right side of the stage when viewed from the audience seats. The panning processor 23D controls the volume of each sound signal of the direct sound system so that the sound image is localized at the position of the sound source 65.

The panning processor 23D obtains the position information of the sound source 65 from the position information obtainer 29. The position information is information indicating two-dimensional or three-dimensional coordinates with respect to a certain position of the room 62. The position information of the sound source 65 can be obtained by a beacon and a tag that transmit and receive a radio wave of, for example, Bluetooth (registered trademark). In the room 62, at least three beacons are installed in advance. The sound source 65 includes a tag. That is, a tag is attached to a performer or an instrument. Each beacon transmits and receives radio waves to and from the tag. Each beacon measures the distance to the tag based on the time difference between transmitting and receiving of radio waves. If the position information obtainer 29 obtains the position information of the beacon in advance, the position of the tag can be uniquely obtained by measurement of the distances from at least three beacons to the tag.

The position information obtainer 29 obtains the position information of the sound source 65 by obtaining the position information of the tag measured in the above manner. Further, the position information obtainer 29 obtains the position information of each of the speakers 51A to 51J and the speakers 61A to 61F in advance.

The panning processor 23D controls the volume of each sound signal output to the speakers 51A to 51J and the speakers 61A to 61F so that the sound image is localized at the position of the sound source 65 based on the obtained position information and the position information of the speakers 51A to 51J and the speakers 61A to 61F, so as to generate the direct sound control signal.

The panning processor 23D controls the volume according to the distance between the sound source 65 and each of the speakers, the speakers 51A to 51J and the speakers 61A to 61F. For example, the panning processor 23D increases the volume of the sound signal output to the speaker near the position of the sound source 65, and decreases the volume of the sound signal output to the speaker far from the position of the sound source 65. In this manner, the panning processor 23D can localize the sound image of the sound source 65 at a predetermined position. For example, in the example of FIG. 4, the panning processor 23D increases the volume of the sound signal output to the three speakers 51F, 51G, and 51H close to the sound source 65, and decreases the volume of the other speakers. In this manner, the sound image of the sound source 65 is localized on the right side of the stage when viewed from the audience seats.

If the sound source 65 moves to the left side of the stage, the panning processor 23D changes the volume of each sound signal output to the speakers 51A to 51J and the speakers 61A to 61F based on the position information of the moved sound source 65. For example, the panning processor 23D increases the volume of the sound signal output to the speakers 51A, 51B, and 51F, and decreases the volume of the other speakers. In this manner, the sound image of the sound source 65 is localized on the left side of the stage when viewed from the audience seats.

As described above, the sound signal processor 10 realizes a distribution processor of the present disclosure by the mixer 23 and the panning processor 23D.

Next, the FIR filter 24A and the FIR filter 24B perform indirect sound generation processing (S13). The indirect sound generation processing is processing of individually generating an early reflection sound control signal that reproduces an early reflection sound and a reverberant sound control signal that reproduces a reverberant sound. The FIR filter 24A and the FIR filter 24B correspond to an indirect sound generator of the present disclosure.

Figure 5A:
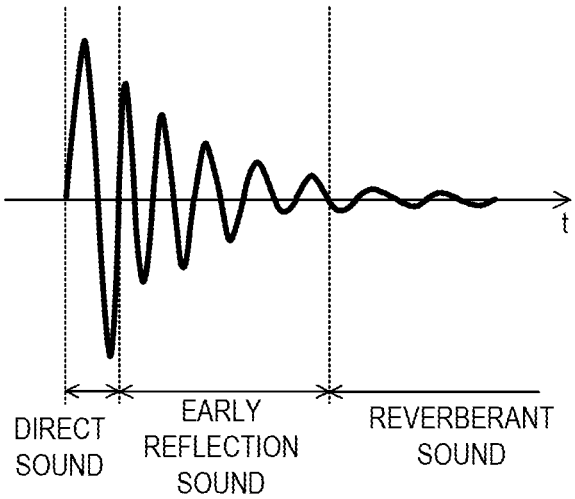
FIG. 5A is a schematic diagram illustrating an example of classification of sound types in a time waveform of an impulse response used for a filter coefficient.
Figure 5B:
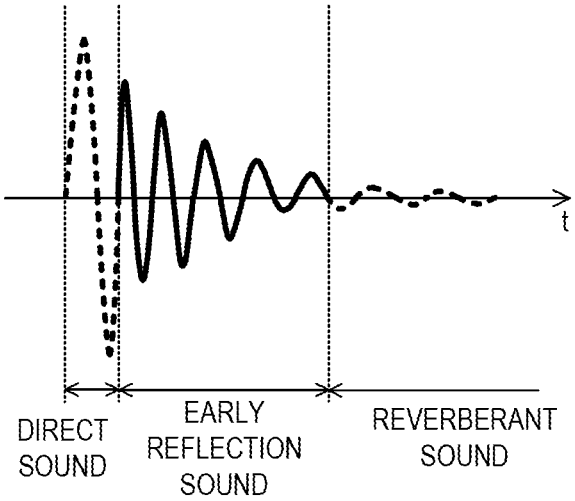
FIG. 5B is a schematic diagram illustrating a time waveform of a filter coefficient set to an FIR filter 24A.
Figure 6A:
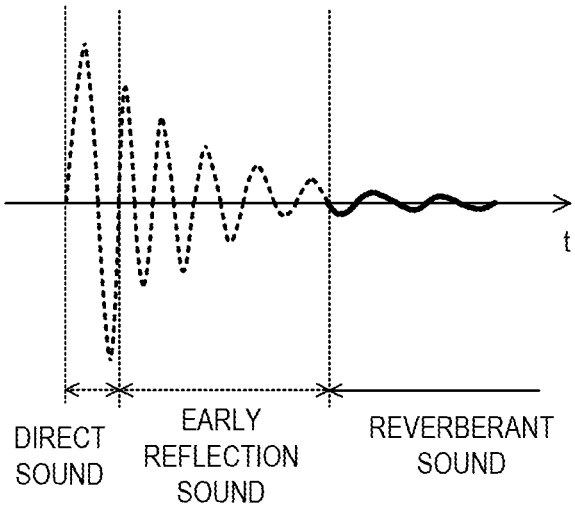
FIG. 6A is a schematic diagram illustrating an impulse response set to an FIR filter 24B.
Figure 6B:
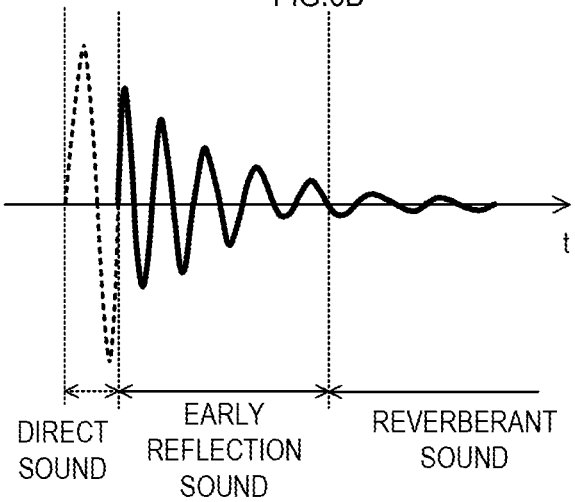
FIG. 6B is a schematic diagram illustrating a time waveform of a filter coefficient set to the FIR filter 24B.

First, the impulse response obtainer 151 sets filter coefficients of the FIR filter 24A and the FIR filter 24B. Here, impulse response data set to the filter coefficient will be described. FIG. 5A is a schematic diagram illustrating an example of classification of sound types in a time waveform of an impulse response used for the filter coefficient, and FIG. 5B is a schematic diagram illustrating a time waveform of the filter coefficient set to the FIR filter 24A. FIGS. 6A and 6B are schematic diagrams illustrating time waveforms of the filter coefficient set in the FIR filter 24B.

As shown in FIG. 5A, an impulse response can be classified into a direct sound, an early reflection sound, and a reverberant sound arranged on the time axis. Then, as shown in FIG. 5B, the filter coefficient set to the FIR filter 24A is set by the portion of the early reflection sound excluding the direct sound and the reverberant sound in the impulse response. As shown in FIG. 6A, the filter coefficient set to the FIR filter 24B is set by the reverberant sound excluding the direct sound and the early reflection sound in the impulse response. As shown in FIG. 6B, the FIR filter 24B may be set by the early reflection sound and the reverberant sound excluding the direct sound in the impulse response.

Data of the impulse response is stored in the memory 31. The impulse response obtainer 151 obtains data of an impulse response from the memory 31. However, the data of an impulse response does not need to be stored in the memory 31. The impulse response obtainer 151 may download the data of an impulse response from, for example, a server (not shown) each time.

The impulse response obtainer 151 may obtain the data of an impulse response in which only the early reflection sound is cut out in advance and set the data to the FIR filter 24A. Alternatively, the impulse response obtainer 151 may obtain the data of an impulse response including the direct sound, the early reflection sound, and the reverberant sound, cut out only the early reflection sound, and set the data to the FIR filter 24A. Similarly, when only the reverberant sound is used, the impulse response obtainer 151 may obtain the data of an impulse response obtained by cutting out only the reverberant sound in advance and set the data to the FIR filter 24B. Alternatively, the impulse response obtainer 151 may obtain the data of an impulse response including the direct sound, the early reflection sound, and the reverberant sound, cut out only the reverberant sound, and set the data to the FIR filter 24B.

Figure 7:
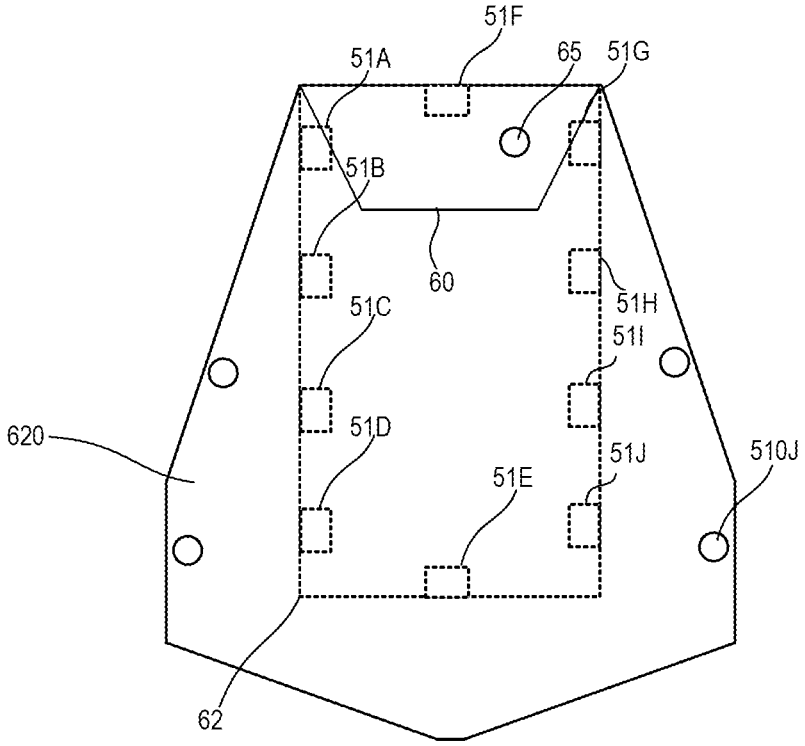
FIG. 7 is a plan view schematically illustrating a relationship between a space 620 and the room 62.

FIG. 7 is a plan view schematically illustrating a relationship between a space 620 and the room 62. As shown in FIG. 7, the data of an impulse response is measured in advance in the predetermined space 620 such as a concert hall or a church where the sound field is to be reproduced. For example, the data of an impulse response is measured in a manner that a test sound (pulse sound) is generated at the position of the sound source 65 and the sound is collected with a microphone.

The data of an impulse response may be obtained at any position in the space 620. However, it is preferable to measure the data of an impulse response of the early reflection sound using a directional microphone installed near a wall surface. The early reflection sound is a clear reflection sound in the direction of arrival. Therefore, by measuring the data of an impulse response with a directional microphone installed near a wall surface, it is possible to precisely obtain the reflection sound data of the target space. In contrast, the reverberant sound is a reflection sound in which the direction of arrival of the sound is uncertain. Therefore, the data of an impulse response of the reverberant sound may be measured with a directional microphone installed near the wall surface, or may be measured by using an omnidirectional microphone different from one used for the early reflection sound.

The FIR filter 24A convolves data of different impulse responses with ten sound signals of the second system. When there are a plurality of signal processing systems, the FIR filter 24A and the FIR filter 24B may be provided for each of the signal processing systems. For example, ten of the FIR filters 24A may be provided.

As described above, when a directional microphone installed near a wall surface is used, the data of an impulse response is measured with a separate directional microphone for each signal processing system. For example, as shown in FIG. 7, for a signal processing system corresponding to the speaker 51J installed on the right rear side from the stage 60, the data of an impulse response is measured with a directional microphone 510J installed near a wall surface on the right rear side from the stage 60.

The FIR filter 24A convolves the data of an impulse response with each sound signal of the second system. The FIR filter 24B convolves the data of an impulse response with each sound signal of the first system.

The FIR filter 24A generates an early reflection sound control signal that reproduces an early reflection sound in a predetermined space by convolving the data of an impulse response of a set early reflection sound with an input sound signal. The FIR filter 24B generates a reverberant sound control signal that reproduces a reverberant sound in a predetermined space by convolving the data of an impulse response of a set reverberant sound with an input sound signal.

The level setter 25A adjusts the level of the early reflection sound control signal. The level setter 25B adjusts the level of the reverberant sound control signal. The level balance adjuster 152 sets a level adjustment amount of the panning processor 23D, the level setter 25A, and the level setter 25B. The level balance adjuster 152 refers to a level of each of the direct sound control signal, the early reflection sound control signal, and the reverberant sound control signal, and adjusts the level balance of these signals. For example, the level balance adjuster 152 adjusts the level balance between the last level in time of the direct sound control signal and the first component in time of the early reflection sound control signal. Further, the level balance adjuster 152 adjusts the balance between the level of the last component in time of the early reflection sound control signal and the level of the first component in time of the reverberant sound control signal. Alternatively, the level balance adjuster 152 may adjust the balance between the power of a plurality of components of the latter half in time of the early reflection sound control signal and the power of a component of the first half in time of the reverberant sound control signal. In this manner, the level balance adjuster 152 can individually control the sounds of the direct sound control signal, the early reflection sound control signal, and the reverberant sound control signal, and control the sounds to be in an appropriate balance according to the space to which the sounds are applied.

The delay adjuster 28 adjusts delay time according to the distance between an optional microphone and a plurality of speakers. For example, for a plurality of speakers, the delay adjuster 28 sets the delay time to be smaller in ascending order of distances between the directional microphone 11B and the speakers. Alternatively, the delay adjuster 28 adjusts the delay time from the positions of the sound source and the microphone for which to measure the impulse response in the space 620 that reproduces the sound field. For example, in the FIR filter 24A, when the impulse response data measured at the directional microphone 510J installed in the space 620 is convolved with the speaker 51J, the delay time corresponding to the distance between the directional microphone 510J and the sound source 65 in the space 620 is set to the delay time of the speaker 51J in the delay adjuster 28. In this manner, the early reflection sound control signal and the reverberant sound control signal reach the listener later than the direct sound control signal, so that clear sound image localization and rich space expansion are realized.

It is preferable that the sound signal processor 10 do not perform delay adjustment on the direct sound control signal. If the position of the sound source 65 changes significantly in a short period of time when the sound image localization is controlled by the delay adjustment, phase interference occurs between the sounds output from a plurality of speakers. By not performing the delay adjustment on the direct sound control signal, the sound signal processor 10 can maintain the timbre of the sound source 65 without causing phase interference even if the position of the sound source 65 changes significantly in a short time.

Next, the output signal generator 26 mixes the direct sound control signal, the early reflection sound control signal, and the reverberant sound control signal to generate an output signal (S14). The output signal generator 26 may perform gain adjustment of each signal, adjustment of the frequency characteristics, and the like at the time of mixing.

The output unit 27 converts an output signal output from the output signal generator 26 into an analog signal. Further, the output unit 27 amplifies the analog signal. The output unit 27 outputs the amplified analog signal to a corresponding speaker (S15).

With the above configuration, the sound signal processor 10 obtains a sound signal, controls the volume of the sound signal and distributes the sound signal to a plurality of systems, generates a direct sound control signal, an early reflection sound control signal, and a reverberant sound control signal from the sound signal, and mixes the distributed sound signal, the direct sound control signal, the early reflection sound control signal, and the reverberant sound control signal to generate an output signal. In this manner, the sound signal processor 10 realizes clearer sound image localization and richer space expansion than before.

In particular, the sound signal processor 10 realizes the localization of a sound source by controlling the volume of a sound signal distributed to a plurality of speakers based on the position information of the sound source. Accordingly, it is possible to uniformly localize a clear sound image over a wide range in real time without depending on a reproduction environment such as the number and arrangement of speakers.

Further, the sound signal processor 10 outputs an early reflection sound control signal and a reverberant sound control signal from a plurality of speakers in addition to a direct sound control signal. In this manner, the audience listens to the early reflection sound control signal and the reverberant sound control signal in addition to the direct sound control signal. Therefore, the audience does not pay attention only to a specific speaker to which the direct sound control signal is output. Therefore, even when the number of speakers is small and the distance between the speakers is wide, the sound image is not localized only in a specific speaker.

The omnidirectional microphone 12A, the omnidirectional microphone 12B, and the omnidirectional microphone 12C collect the entire sound in the room 62, including the direct sound of the sound source 65 and the reflection sound in the room 62. Therefore, if the sound signal processor 10 generates a reverberant sound control signal using sound signals obtained by the omnidirectional microphone 12A, the omnidirectional microphone 12B, and the omnidirectional microphone 12C, the same reverberant is reproduced in the sound of the stage and in the sound of the audience seat. Therefore, for example, the same reverberant is reproduced in the sound of the performer and in the sound of the applause of the audience, and the audience can obtain a sense of unity.

Further, the early reflection sound has a smaller number of reflections than the reverberant sound that undergoes multiple reflections in the space. For this reason, the energy of the early reflection sound is higher than the energy of the reverberant sound. Therefore, by increasing the level of each speaker that outputs the early reflection sound control signal, the effect of the subjective impression of the early reflection sound can be improved, and the controllability of the early reflection sound can be improved.

Further, by reducing the number of speakers that output the early reflection sound control signal, it is possible to suppress an excessive increase in diffused sound energy. That is, the extension of the reverberant in the room due to the early reflection sound control signal can be suppressed, and the controllability of the early reflection sound can be improved.

As the speaker that outputs the direct sound control signal and the early reflection sound control signal is installed on the side of the room, which is located close to the audience, the speaker can be easily controlled to deliver a direct sound and an early reflection sound to the audience, and the controllability of the early reflection sound can be improved. Further, by installing the speaker that outputs the reverberant sound control signal on the ceiling of the room, it is possible to suppress the difference in the reverberant sounds due to the positions of the audience.

The description of the present embodiment is exemplary in all respects and is not restrictive. The scope of the present disclosure is shown not by the above-described embodiment but by the scope of claims. Furthermore, the scope of the present disclosure is intended to include all modifications within the meaning and scope equivalent to those of the claims.

What is claimed is:

1. A sound signal processing method comprising:

receiving a sound signal from a real-world sound source;

generating an early reflection sound control signal that reproduces an early reflection sound and a reverberant sound control signal that reproduces a reverberant sound from the sound signal;

generating a direct sound control signal to reproduce a direct sound, by controlling a volume of the sound signal and then distributing the sound signal to output lines according to a distance between the real-world sound source and each of a plurality of speakers so that a sound image of the real-world sound source is localized at a position of the real-world sound source; and mixing the direct sound control signal, the early reflection sound control signal, and the reverberant sound control signal to generate an output signal.

2. The sound signal processing method according to claim 1, further comprising:

obtaining an impulse response of an early reflection sound measured in advance in a space and an impulse response of a reverberant sound measured in advance in the space;

convolving the impulse response of the early reflection sound with the sound signal to generate the early reflection sound control signal; and convolving the impulse response of the reverberant sound with the sound signal to generate the reverberant sound control signal.

3. The sound signal processing method according to claim 2, wherein the sound signal to be convolved with the impulse response of the reverberant sound is received from an omnidirectional microphone.

4. The sound signal processing method according to claim 1, wherein receiving the sound signal from the real-world sound source comprises receiving a line-inputted sound signal.

5. The sound signal processing method according to claim 1, wherein receiving the sound signal from the real-world sound source comprises receiving the sound signal from a microphone disposed on a performer.

6. The sound signal processing method according to claim 5, wherein the microphone is a directional microphone.

7. The sound signal processing method according to claim 1, further comprising:

obtaining position information of the real-world sound source; and localizing, in a case where the real-world sound source moves, the sound image of the real-world sound source at the position of the moved real-world sound source, based on the obtained position information of the real-world sound source.

8. A sound signal processing device comprising:

a processor configured to execute computer readable instructions stored in a memory; and a digital signal processor configured to execute signal processing, wherein the processor is configured to execute the computer readable instructions stored in the memory and the digital signal processor is configured to execute the signal processing to cause the signal processing device to:

obtain a sound signal from a real-world sound source;

generate an early reflection sound control signal that reproduces an early reflection sound from the sound signal;

generate a reverberant sound control signal that reproduces a reverberant sound from the sound signal;

generate a direct sound control signal to reproduce a direct sound, by controlling a volume of the sound signal and then distributing the sound signal to output lines according to a distance between the real-world sound source and each of a plurality of speakers so that a sound image of the real-world sound source is localized at a position of the real-world sound source; and generate an output signal by mixing the direct sound control signal, the early reflection sound control signal, and the reverberant sound control signal.

9. The sound signal processing device according to claim 8, wherein the processor is configured to execute the computer readable instructions stored in the memory and the digital signal processor is configured to execute the signal processing to further cause the signal processing device to:

obtain an impulse response of an early reflection sound measured in advance in a space and an impulse response of a reverberant sound measured in advance in the space;

convolve the impulse response of the early reflection sound with the sound signal to generate the early reflection sound control signal; and convolve the impulse response of the reverberant sound with the sound signal to generate the reverberant sound control signal.

10. The sound signal processing device according to claim 9, wherein the sound signal to be convolved with the impulse response of the reverberant sound is received from an omnidirectional microphone.

11. The sound signal processing device according to claim 8, wherein the signal processing device is caused to obtain the sound signal from the real-world sound source by receiving a line-inputted sound signal.

12. The sound signal processing device according to claim 8, wherein the signal processing device is caused to obtain the sound signal from the real-world sound source by receiving the sound signal from a microphone disposed on a performer.

13. The sound signal processing device according to claim 12, wherein the microphone is a directional microphone.

14. The sound signal processing device according to claim 8, wherein the processor is configured to execute the computer readable instructions stored in the memory and the digital signal processor is configured to execute the signal processing to further cause the signal processing device to:

obtain position information of the real-world sound source; and localize, in a case where the real-world sound source moves, the sound image of the real-world sound source at the position of the moved real-world sound source, based on the obtained position information of the real-world sound source.

15. A non-transitory computer readable storage medium that stores a sound signal processing program for causing a sound signal processing device to execute processing of:

receiving a sound signal from a real-world sound source;

generating an early reflection sound control signal that reproduces an early reflection sound and a reverberant sound control signal that reproduces a reverberant sound from the sound signal;

generating a direct sound control signal to reproduce a direct sound, by controlling a volume of the sound signal and then distributing the sound signal to output lines according to a distance between the real-world sound source and each of a plurality of speakers so that a sound image of the real-world sound source is localized at a position of the real-world sound source; and mixing the direct sound control signal, the early reflection sound control signal, and the reverberant sound control signal to generate an output signal.

* * * * *